US006863044B2

(12) United States Patent
Nakamura et al.

(10) Patent No.: US 6,863,044 B2
(45) Date of Patent: Mar. 8, 2005

(54) AIR INTAKE DEVICE OF INTERNAL COMBUSTION ENGINE

(75) Inventors: Akio Nakamura, Kanagawa (JP); Hideaki Miyamoto, Yokohama (JP); Kouji Yamashita, Kanagawa (JP); Shinsuke Kitabayashi, Saitama (JP)

(73) Assignees: Nissan Motor Co., Ltd., Yokohama (JP); Mahle Tennex Corporation, Tokyo (JP)

( * ) Notice: Subject to any disclaimer, the term of this patent is extended or adjusted under 35 U.S.C. 154(b) by 0 days.

(21) Appl. No.: 10/366,517

(22) Filed: Feb. 14, 2003

(65) Prior Publication Data

US 2003/0154951 A1 Aug. 21, 2003

(30) Foreign Application Priority Data

Feb. 18, 2002 (JP) ..... 2002-039655

(51) Int. Cl.[7] ..... F02M 35/04
(52) U.S. Cl. ..... 123/198 E
(58) Field of Search ..... 123/198 E, 184.42, 123/78 L

(56) References Cited

U.S. PATENT DOCUMENTS 4,517,940 A * 5/1985 Koyanagi et al. ..... 123/198 E
5,438,965 A * 8/1995 Aronsson et al. ..... 123/198 E
5,605,120 A * 2/1997 Hedelin ..... 123/78 C
5,655,497 A * 8/1997 Nakajima ..... 123/198 E
5,950,586 A * 9/1999 Ropertz ..... 123/184.42
6,022,391 A * 2/2000 Greenlees et al. ..... 55/385.1
6,162,269 A * 12/2000 Greenlees et al. ..... 55/385.1
6,263,850 B1 7/2001 Winmill et al.
6,357,414 B1 * 3/2002 Kalinowski et al. .... 123/198 E
6,395,049 B2 * 5/2002 Knodler et al. ..... 55/385.3
6,537,338 B2 * 3/2003 Inoue et al. ..... 55/385.3

FOREIGN PATENT DOCUMENTS

| | | | |
|---|---|---|---|
| DE | 32 32 583 | A1 | 3/1984 |
| DE | 195 07 354 | A1 | 9/1996 |
| EP | 0 931 926 | A1 | 7/1999 |
| JP | 07-103092 | A | 4/1995 |
| JP | 10-184468 | A | 7/1998 |
| JP | 10-246159 | A | 9/1998 |
| JP | 10-246160 | A | 9/1998 |
| JP | 10-266913 | A | 10/1998 |
| JP | 11-125160 | A | 5/1999 |
| JP | 11-294271 | A | 10/1999 |
| JP | 2000-227057 | A | 8/2000 |
| JP | 2001-323842 | A | 11/2001 |

* cited by examiner

*Primary Examiner*—Henry C. Yuen
*Assistant Examiner*—Jason Benton
(74) *Attorney, Agent, or Firm*—Foley & Lardner LLP

(57) ABSTRACT

An air intake device for use with an internal combustion engine has an air cleaner case adapted to be mounted on the engine to extend longitudinally along an upper wall of the engine. An opening is formed in a longitudinal end portion of a bottom wall of the air cleaner case. An air cleaner body has an open end that is connected to the opening of the bottom wall of the air cleaner case thereby to communicate an interior of the air cleaner body with that of the air cleaner case. An air cleaner element is put between the air cleaner body and the air cleaner case in a manner to extend across the opening of the bottom wall of the air cleaner case.

24 Claims, 12 Drawing Sheets

AIR INTAKE DEVICE OF INTERNAL COMBUSTION ENGINE

BACKGROUND OF INVENTION

1. Field of Invention

The present invention relates in general to air intake devices of internal combustion engines, and more particularly to the air intake devices of a type that includes an air cleaner. More specifically, the present invention is concerned with the air intake devices of a compact type suitable for use in a limited space defined above the engine in an engine room of a motor vehicle.

2. Description of Related Art

Hitherto, various air intake devices have been proposed and put into practical use particularly in the field of wheeled motor vehicles. Some are of a type that includes an air cleaner located away from the internal combustion engine and a flexible duct extending between the air cleaner and an in intake manifold of the engine. However, in recent years, because compactness and aesthetic designing needed by the motor vehicles, the vehicles tend to have a limited engine room space, particularly the space above the engine. In the air intake devices of such vehicles, an air cleaner is directly mounted on the engine to meet the space saving.

The air intake devices of such space saving type are shown in Laid-open Japanese Patent Applications (Tokkaihei) 10-266913 and 2001-323842.

SUMMARY OF INVENTION

However, due to their inherent construction, known air intake devices such as those disclosed by the publications fail to exhibit a satisfied space saving and a satisfied air intake effect.

Accordingly, it is an object of the present invention to provide an air intake device of an internal combustion engine, that fulfills a satisfied space saving in the engine room while exhibiting a satisfied air intake effect.

According to a first aspect of the present invention, there is provided an air intake device for use with an internal combustion engine, which comprises an air cleaner case adapted to be mounted on the engine to extend longitudinally along an upper wall of the engine; an opening formed in a longitudinal end portion of a bottom wall of the air cleaner case; an air cleaner body having an open end connected to the opening of the bottom wall of the air cleaner case thereby to communicate an interior of the air cleaner body with that of the air cleaner case; and an air cleaner element put between the air cleaner body and the air cleaner case in a manner to extend across the opening of the bottom wall of the air cleaner case.

According to a second aspect of the present invention, there is provided an air intake device for use with an internal combustion engine, which comprises an elongate air cleaner case adapted to be mounted on the engine, the air cleaner case having a given end portion that extends beyond one longitudinal end of the engine; an opening formed in the given end portion of the elongate air cleaner case; an air cleaner body having an open end, the air cleaner body being pivotally connected to the given end portion of the air cleaner case, so that the air cleaner body is pivotal between a fitted position wherein the air cleaner body is tightly fitted to the given end portion thereby to connect the open end of the air cleaner body with the opening of the given end portion of the air cleaner case and a released position wherein the air cleaner body is separated from given end portion; a clamp that detachably binds the air cleaner body and the air cleaner case together; a flange formed around the open end of the air cleaner body; and an air cleaner element put on the flange, so that when the air cleaner body assumes the fitted position, the air cleaner element is put between the air cleaner body and the given end portion in a manner to extend to across the opening of the opening of the given end portion.

DETAILED DESCRIPTION OF EMBODIMENT

Figure 1:
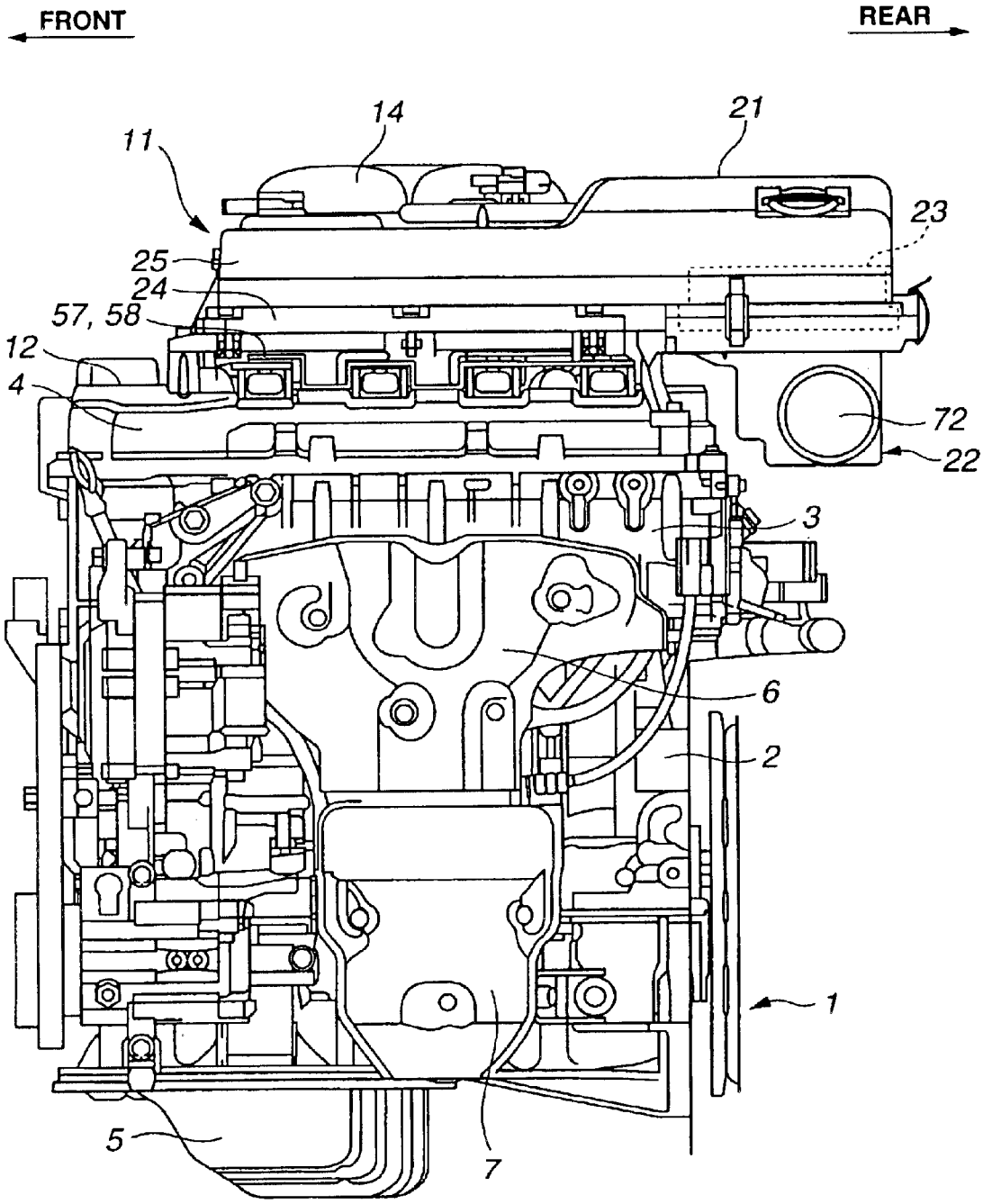
FIG. 1 is a side view of an internal combustion engine to which an air intake device of the present invention is practically applied.

Referring to FIG. 1, there is shown an internal combustion engine 1 to which an air intake device of the present invention is practically applied. Engine 1 shown is of a four cylinder in-line type, used for a FF type (viz., front engine and front drive type) motor vehicle and transversely mounted in an engine room of the vehicle.

As is seen from FIG. 1, engine 1 comprises generally a cylinder block 2 having cylinders, a cylinder head 3 mounted on cylinder block 2, a cylinder head cover 4 put on cylinder head 3, an oil pan 5 mounted below cylinder block 2, an intake manifold mounted on a hidden side of cylinder head 3, an exhaust manifold 6 mounted on this side of cylinder block 3 and a catalytic converter 7 connected to exhaust manifold 6.

It is to be noted that engine 1 shown in FIG. 1 is taken from a forward position of an associated motor vehicle. For ease of description, a left part of the engine will be referred to "front part" and a right part of the same will be referred to "rear part".

An air cleaner 11 is tightly mounted on an upper part of cylinder head cover 4 through four bolts 15. As shown, air cleaner 11 has a substantially flat structure and has a portion that extends rearward from the rear end of engine 1.

Figure 2:
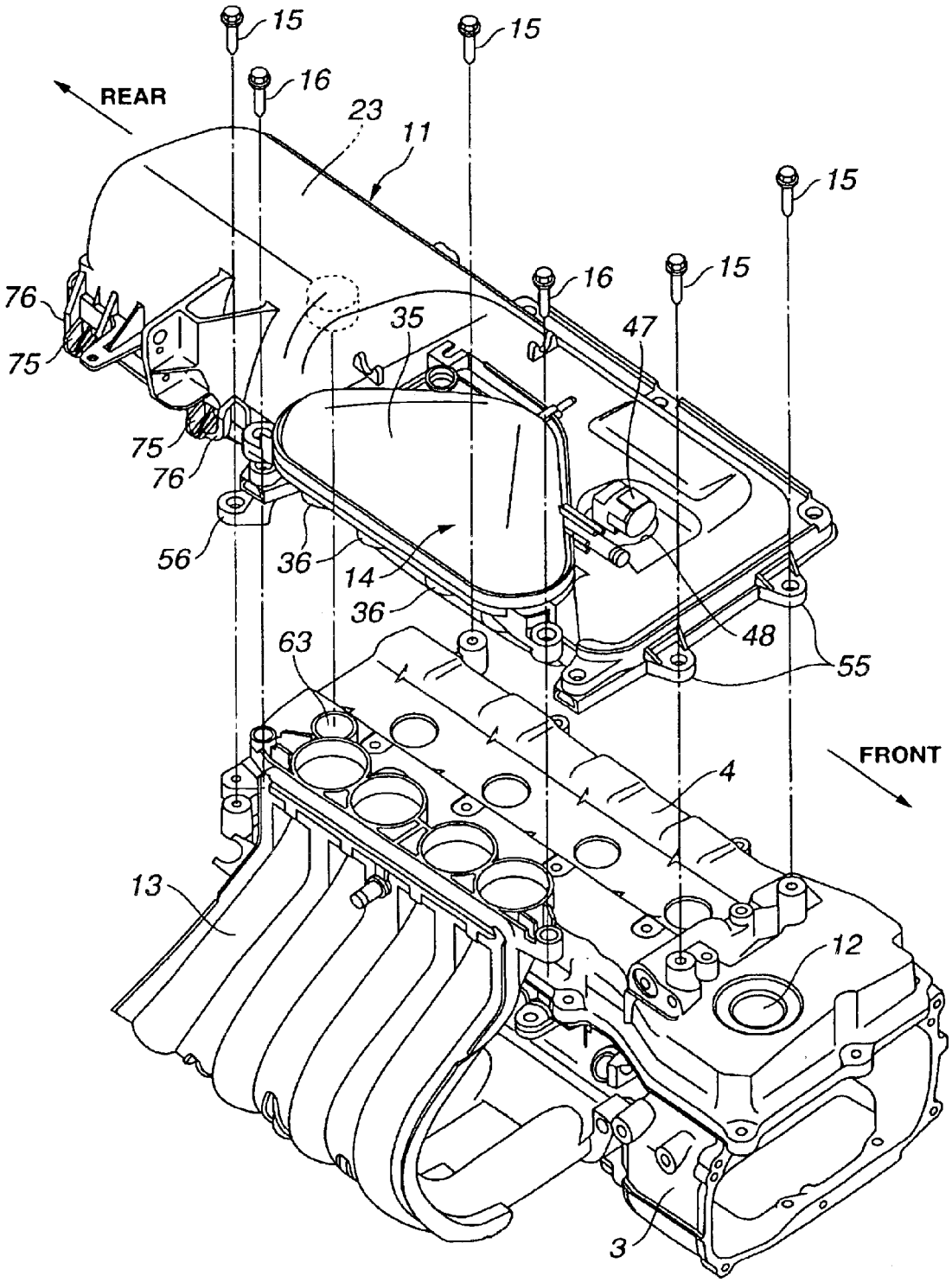
FIG. 2 is an exploded view of the air intake device, showing an air cleaner and an upper structure of the engine.

As is seen from FIG. 2 that shows a positional relation between air cleaner 11 and cylinder head cover 4, cylinder head 3 of engine 1 is equipped with a DOHC type (viz., double over head cam type) valve operating mechanism. For covering the valve operating mechanism, cylinder head cover 4 is mounted on cylinder head 3, that is constructed of a reinforced hard plastic, aluminum, aluminum alloy or the like.

As is seen from FIG. 2, air cleaner 11 is rectangular in shape, having a width generally the same as that of cylinder head cover 4. Cylinder head cover 4 is formed at a front end portion thereof with an oil pouring opening 12. As is seen, air cleaner 11 covers entirely the upper part of cylinder head cover 4 except a part that surrounds oil pouring opening 12.

As is seen from FIG. 2, an intake manifold 13 is mounted to cylinder head 3 on a side opposite to the side to which the above-mentioned exhaust manifold 6 is mounted. That is, when mounted in a motor vehicle, the side of cylinder head 3 to which the intake manifold 13 is mounted faces rearward of the associated motor vehicle. Intake manifold 13 is constructed of a reinforced hard plastic and has four air intake branches united together.

An air collection depressed part 14 is integrally defined by air cleaner 11, which is to be connected to the above-mentioned intake manifold 13. As will be described in detail hereinafter, to air collection depressed part 14, there is connected a plastic cover 35. Two bolts 16 are used for connecting air cleaner 11 to intake manifold 13.

Figure 3:
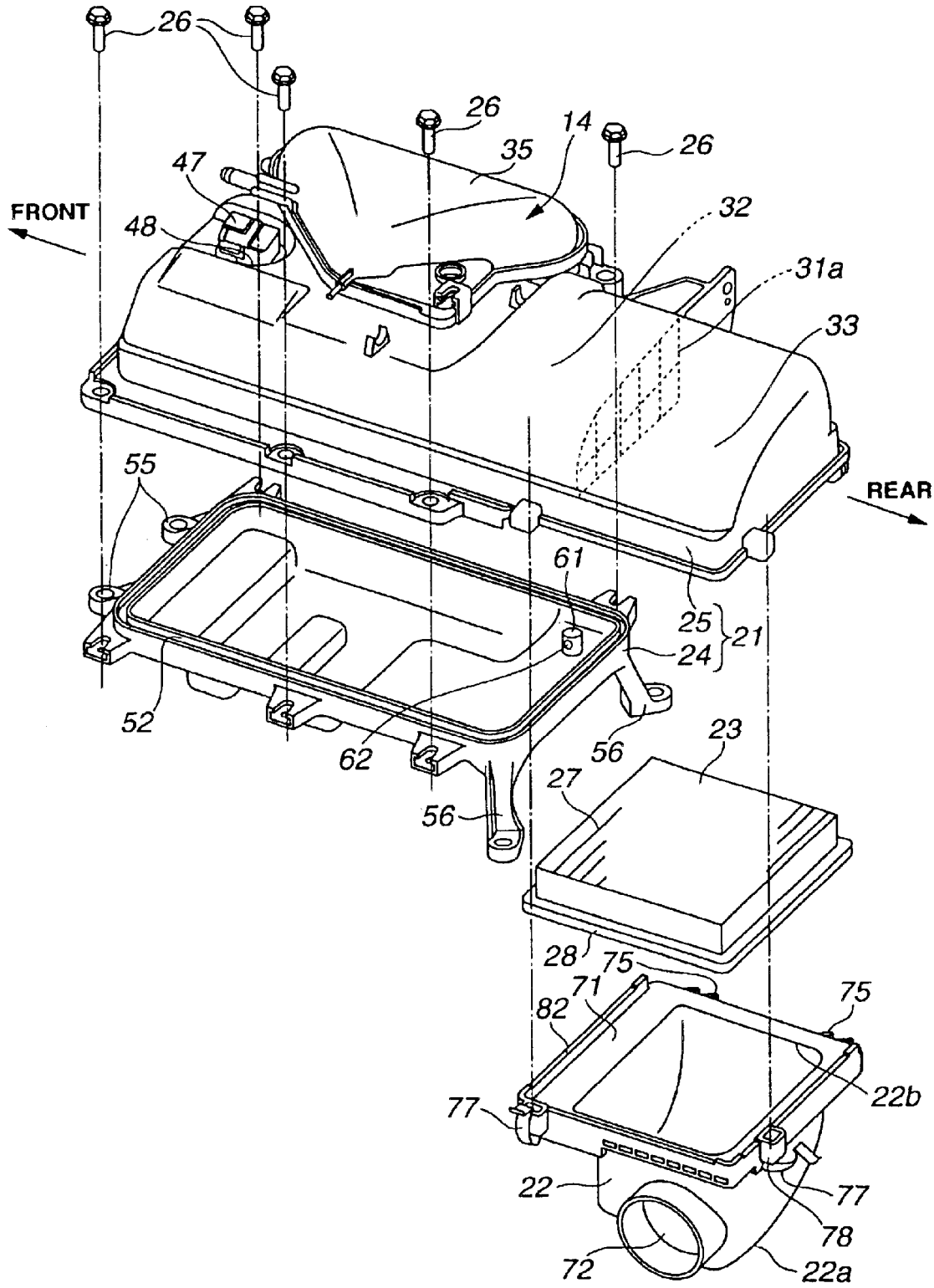
FIG. 3 is an exploded view of the air cleaner.

As is well seen from FIG. 3, air cleaner 11 generally comprises an elongate air cleaner case 21 that is tightly mounted on the upper portion of engine 1, an air cleaner body 22 that is mounted to a bottom wall of air cleaner case 21 and an air cleaner element 23 that is put between air cleaner case 21 and air cleaner body 22. As is seen, air cleaner body 22 is mounted to a rear end portion of the bottom wall of air cleaner case 21.

Air cleaner case 21 comprises a lower case 24 and an upper case 25 which are detachably coupled together to constitute a hollow structure. Upper case 25 is longer than lower case 24 for the purpose which will become apparent as the description proceeds. Lower case 24 is fixed to cylinder head cover 4 through the above-mentioned bolts 15. Upper case 25 is mounted on lower case 24 through five bolts 26. As seen, air cleaner case 21 is shaped substantially flat.

As is seen from FIG. 3, air cleaner element 23 is shaped rectangular and comprises a pleated filter material 27 that is disposed on a rectangular seal member 28. Seal member 28 is made of a flexible urethane foam or the like. It is to be noted that in the illustrated embodiment the interior of air cleaner body 22 constitutes an upstream side (or dust side) of air cleaner element 23 and the interior of air cleaner case 21 constitutes a downstream side (or clean side) of the element 23.

Figure 5:
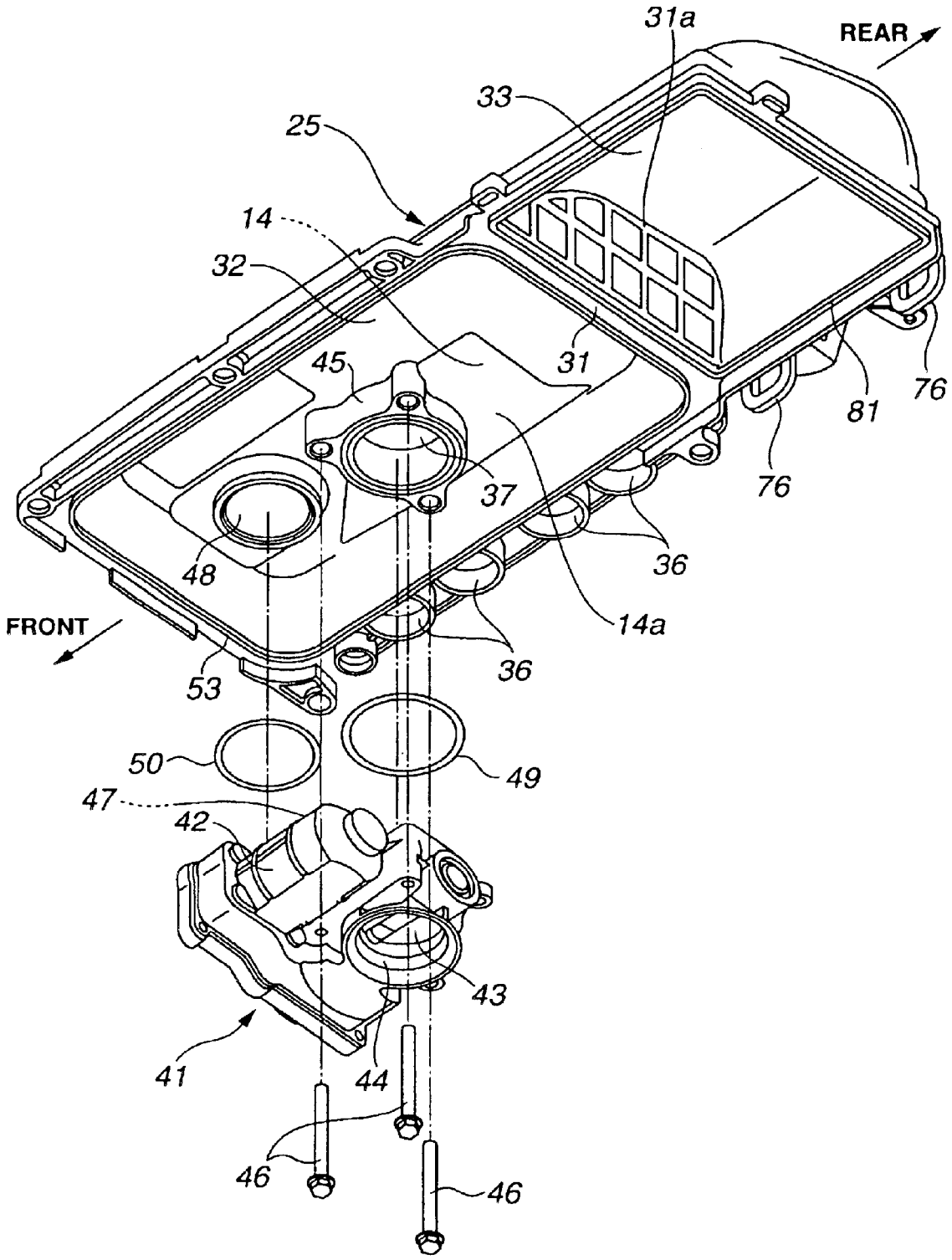
FIG. 5 is a perspective and inside view of an upper case of the air intake device, to which a throttle body is to be connected.

As shown, lower case 24 is shorter than upper case 25. As is seen from FIG. 1, lower case 24 is mounted on the entirely mounted on the given portion of cylinder head cover 4. Accordingly, when mounted on lower case 24, the rear end portion of upper case 25 projects rearward (viz., rightward as viewed in FIG. 1) from the rear end of lower case 24, so that the bottom wall of the projected part of upper case 25 is exposed to the outside facing downward. As shown in FIG. 5, the exposed bottom wall is formed with a rectangular opening 33.

As is seen from FIGS. 1 and 3, the above-mentioned air cleaner body 22 is connected to the rectangular opening 33 of the exposed bottom wall of upper case 25.

As is seen from FIG. 5, the bottom wall of upper case 25 is formed with larger and smaller rectangular openings 32 and 33 which are partitioned by a beam 31. It is to be noted that two inner spaces defined below these two openings 32 and 33 are merged with each other through openings of a grid structure 31*a* defined below beam 31.

Upon assembly, larger rectangular opening 32 is closed by lower case 24 of air cleaner case 21 (see FIGS. 1 and 3), and smaller rectangular opening 33 is connected to an upper open end 22*b* of air cleaner body 22 (see FIG. 3).

The above-mentioned lower case 24 and air cleaner body 22 are both constructed of a reinforced hard plastic.

Figure 6:
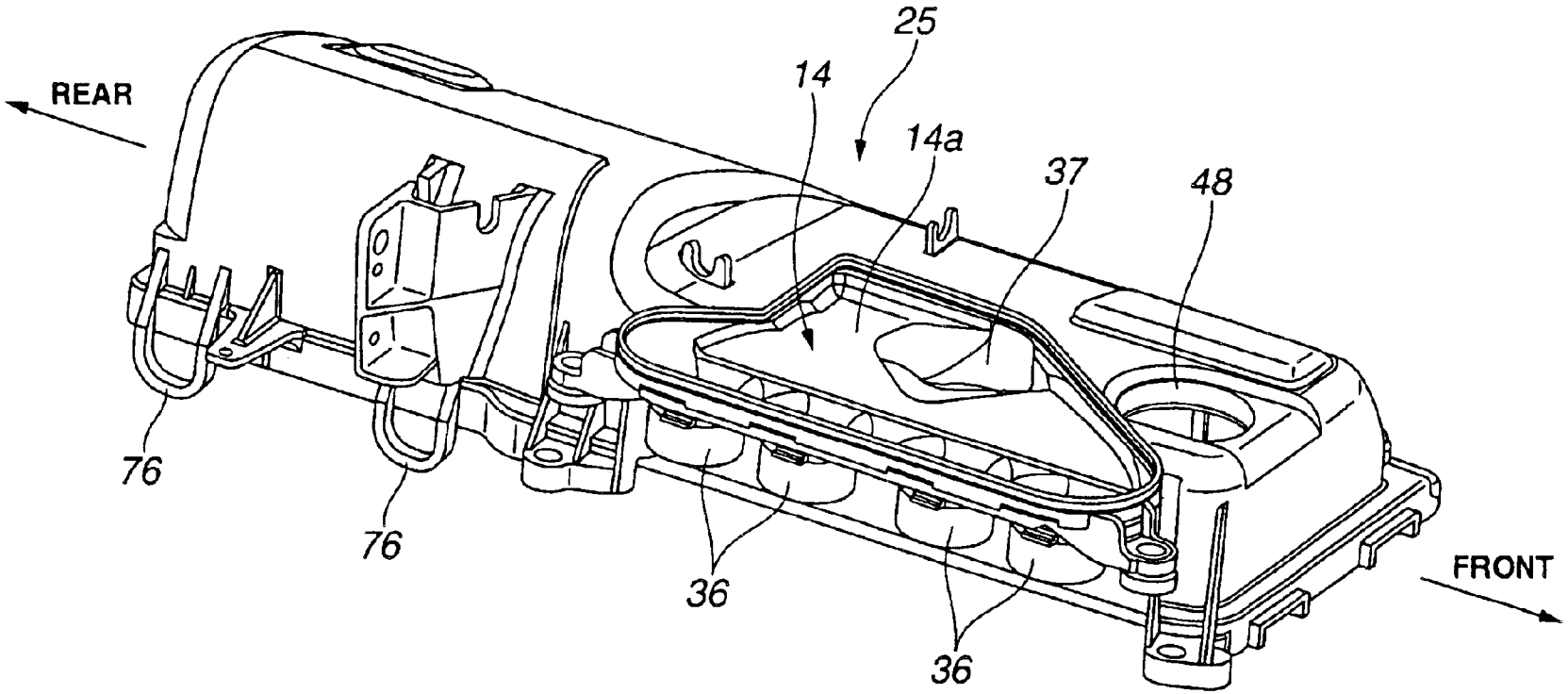
FIG. 6 is a perspective view of the upper case.

As is seen from FIG. 6, the above-mentioned upper case 25 is constructed of a reinforced hard plastic. It is to be noted that upper case 25 shown in the drawing has the cover (35) for air collection depressed part 14 removed. The cover (35) is also constructed of a reinforced hard plastic and connected to air collection depressed part 14 through a welding or the like.

Due to provision of the cover (35), air collection depressed part 14 constitutes an air collection space (14) to which upper open ends of the four air intake branches of intake manifold 13 are exposed (see FIG. 2).

More specifically, as is seen from FIGS. 5 and 6 that show the interior of upper case 25, air collection space 14 is separated from the main interior space of larger rectangular opening 32 by means of a partition wall 14*a*. This partition wall 14*a* is formed with a cylindrical opening 37 through which air collection space 14 and the main interior space are communicated. As will be described in detail hereinafter, cylindrical opening 37 is equipped with a throttle device 41 which selectively opens and closes the opening 37.

Figure 4:
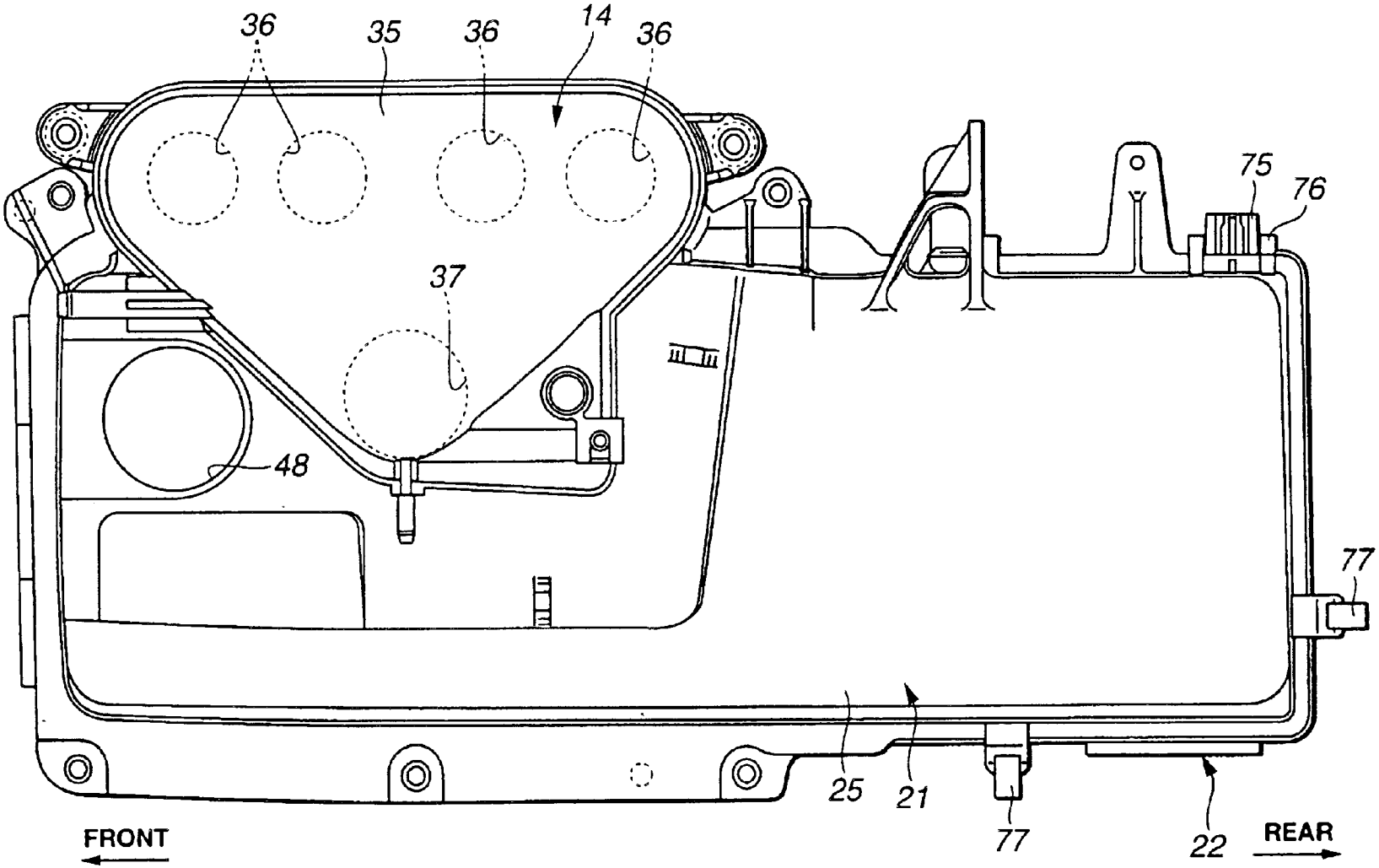
FIG. 4 is a plan view of the air cleaner.

As is seen from FIGS. 4 and 6, along the side edge of upper case 25, there are integrally provided four cylindrical portions 36 of which upper open ends are exposed to the interior of air collection space 14. As is seen from FIG. 2, the four cylindrical portions 36 are detachably connected to the four air intake branches of intake manifold 13.

Thus, as is understood from FIG. 3, cleaned air from air cleaner element 23 is led in order into the smaller chamber 33 of air cleaner case 21, the larger chamber 32 of the same through the openings of grid structure 31*a*, air collection space 14 through cylindrical opening 37 (viz., throttle device 41), and into the four air intake branches of intake manifold 13 through four cylindrical portions 36. Because air collection space 14 has a smaller capacity as compared with the larger chamber 32, improved transient responsibility is expected by the associated engine.

Figure 11:
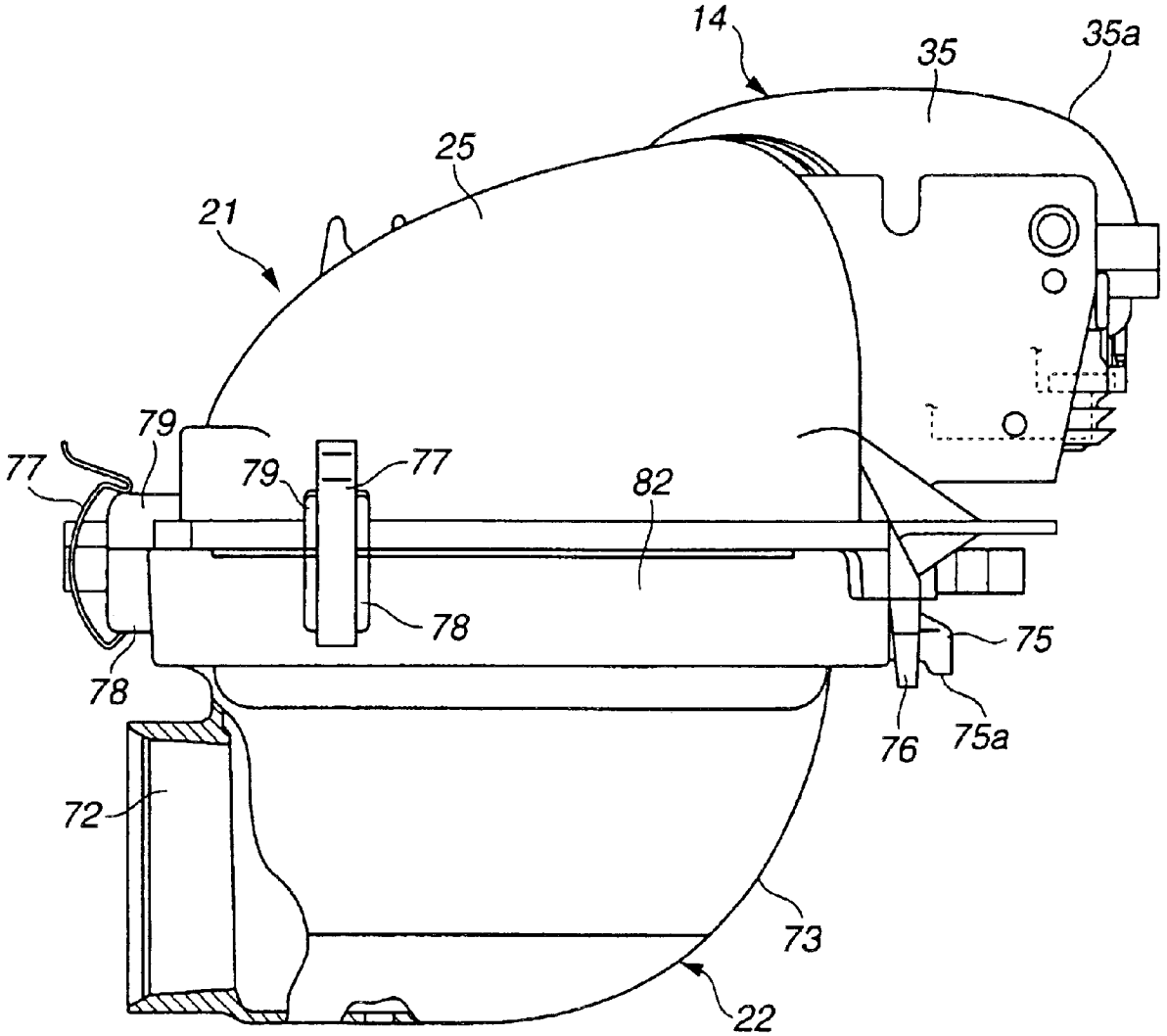
FIG. 11 is a partially cut side view of the essential potion of the air cleaner, taken from a rear side of the engine.

As is seen from FIG. 11, cover 35 for air collection space (14) has a smoothly curved upper wall 35*a* for smoothing the cleaned intake air flowing from cylindrical opening 37 toward the four air intake branches of intake manifold 13.

As is understood from FIGS. 3 and 5, a throttle body 41 that formed the above-mentioned throttle device (41) is installed in the larger chamber 32 of air cleaner case 21. Throttle body 41 has a cylindrical air passage 44 in which a throttle valve 43 driven by an electric motor 42 is operatively installed. As shown, an upper end of cylindrical air passage 44 is fitted to the above-mentioned cylindrical opening 37. For this fitting, three bolts 46 are used which are engaged with threaded bores (no numerals) formed in a boss portion 45 of upper case 25 by which cylindrical opening 37 is defined. For achieving a seal between upper end of cylindrical air passage 44 and cylindrical opening 37, there is used a circular gasket 49. A lower open end of cylindrical air passage 44 is exposed to the interior of the larger rectangular chamber 32 of air cleaner case 21.

Electric motor 42 has a projected connector portion 47 (see FIG. 2) exposed to the upper surface of upper case 25 through a circular opening 48 that is provided in an upper wall of upper case near cylindrical opening 37. Although not shown in the drawings, projected connector portion 47 has a cylindrical ridge at a root portion thereof. For achieving a seal between the cylindrical ridge and circular opening 48, there is used a circular gasket 50.

Figure 7:
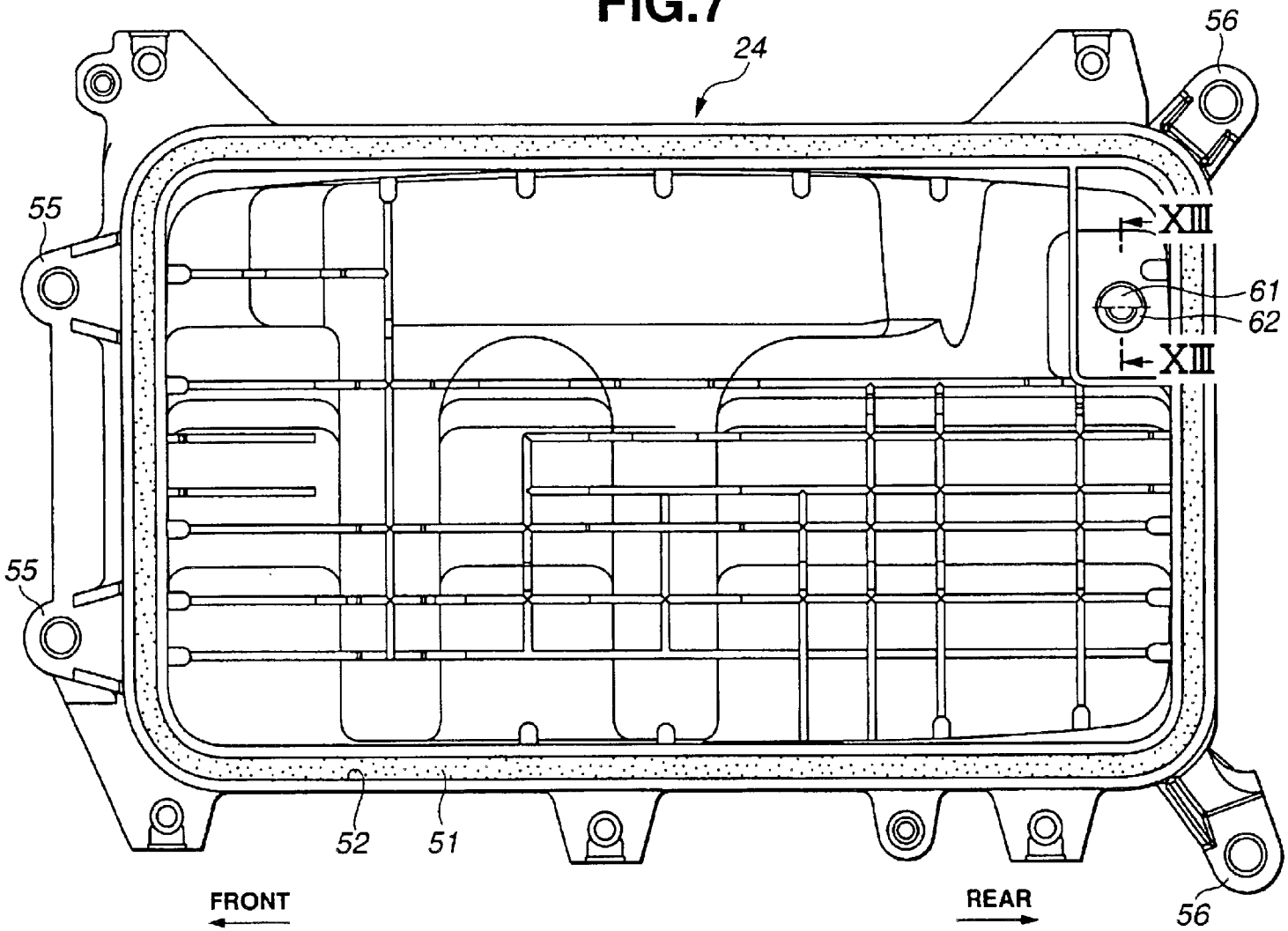
FIG. 7 is a plan view of a lower case of the air intake device.

As is seen from FIG. 7, lower case 24 is equipped along its rectangular peripheral edge with a seal member 51 of flexible rubber material. Due to provision of this seal member 51, sealing between lower case 24 and upper case 25 is achieved. More specifically, the rectangular peripheral edge of lower case 24 is formed with a groove 52 for detachably receiving seal member 51. As is seen from FIGS. 5 and 10, upper case 25 is formed along its rectangular peripheral edge with a ridge 53. That is, upon coupling of these lower and upper cases 24 and 25, the ridge 53 is pressed against seal member 51 to achieve the sealing. It is to be noted that in FIG. 3, the seal member 51 is not shown.

As has been mentioned hereinabove, lower case 24 of air cleaner case 21 is fixed to cylinder head cover 4 through four bolts 15 (see FIG. 2). As is seen from FIGS. 2, 7, 8 and 9, two bolt hole portions 55 for bolts 15 that are provided at the front part of lower case 24 and the other two bolt hole portions 56 for bolts 15 that are provided at the rear part of lower case 24 are sized and constructed by considering the shape of the upper surface of cylinder head cover 4. That is, the bolt hole portions 56 have each a leg portion.

Figure 8:
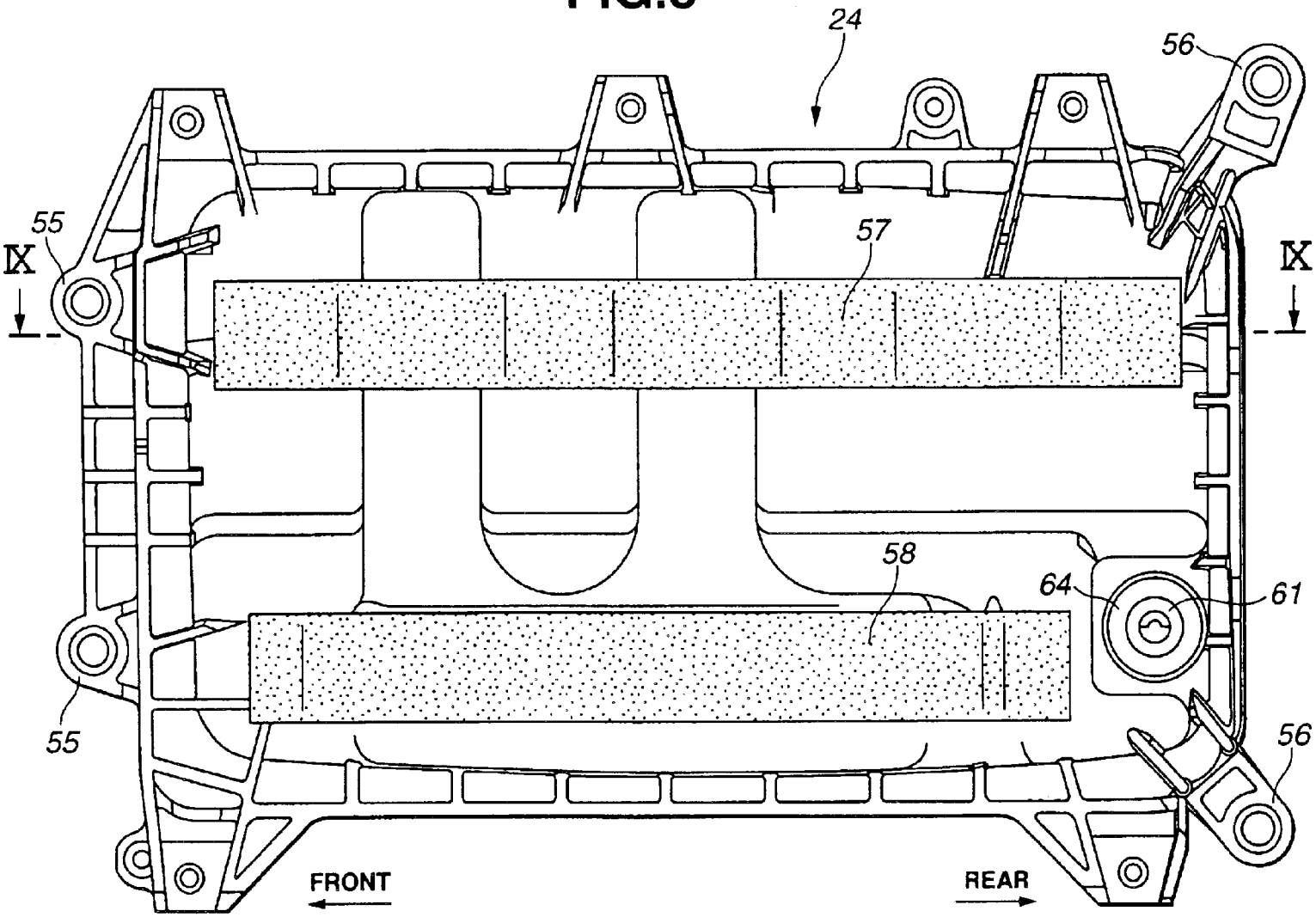
FIG. 8 is a bottom view of the lower case.
Figure 9:
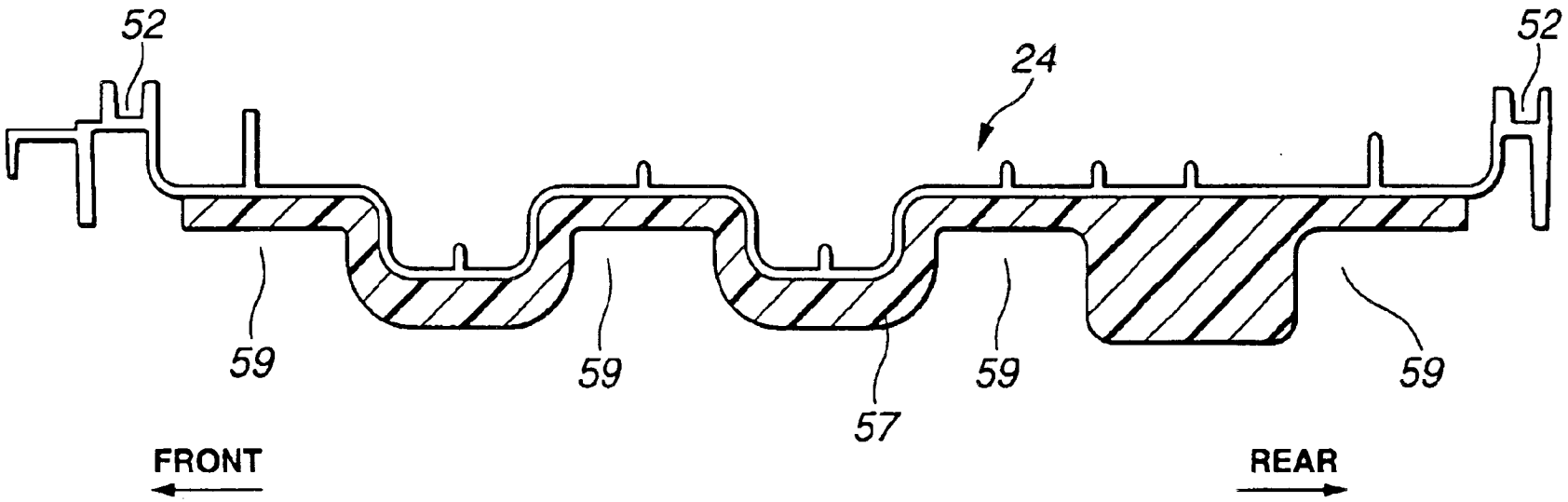
FIG. 9 is a sectional view taken along the line "IX—IX" of FIG. 8.

As is understood from FIGS. 8 and 9, lower case 24 of air cleaner case 21 has a plurality of depressions 59 for avoiding interference with coil members (not shown) mounted on the upper surface of cylinder head cover 4. Each coil member is connected to an ignition plug projected into a corresponding cylinder of the engine. As is seen from FIG. 8, the bottom surface of lower case 24 is equipped with two sound insulating members 57 and 58 of flexible sponge rubber. As is understood from FIG. 9, each sound insulating member 57 or 58 has such a shape as to correspond to the shape of bottom surface of lower case 24 and that of the upper shape of cylinder head cover 4. Each sound insulating member 57 or 58 is bonded to the bottom surface of lower case 24, and upon mounting of lower case 24 onto cylinder head cover 4, the insulating member 57 or 58 is compressed therebetween. Due to provision of sound insulating members 57 and 58, any noise produced from cylinder head cover 4 is damped.

Figure 13:
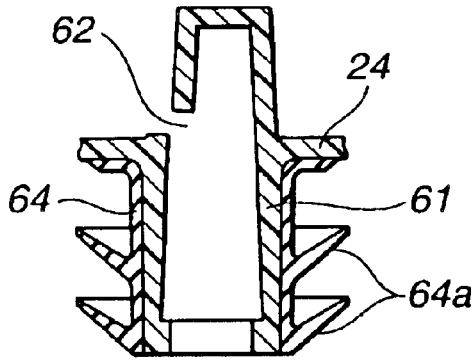
FIG. 13 is an enlarged sectional view taken along the line "XIII—XIII" of FIG. 7.

As is seen from FIGS. 7 and 8, the bottom wall of lower case 24 is integrally formed with a blow-by gas pipe 61. As is seen from FIG. 13, blow-by gas pipe 61 comprises an inner portion that is projected into the interior of the larger chamber 32 of air cleaner case 21 and an outer portion that is projected toward the cylinder head cover 4. The inner portion is formed with a blow-by gas introducing opening 62 that is exposed to the interior of the larger chamber 32 of air cleaner case 21.

As is seen from FIG. 2, when lower case 24 is properly mounted on cylinder head cover 4, the outer portion of blow-by gas pipe 61 is projected into a blow-by gas opening 63 formed in the upper wall of cylinder head cover 4. That is, blow-by gas in cylinder head cover 4 is led into the interior of the larger chamber 32 of air cleaner case 21 from gas opening 63 through blow-by gas pipe 61. As is seen from FIG. 13, for achieving sealing between gas opening 63 and gas pipe 61, a cylindrical seal member 64 with a plurality of seal lips 64*a* is disposed on the outer portion of blow-by gas pipe 61. Seal member 64 is constructed of a flexible rubber material, flexible plastic material or the like.

In the following, construction of air cleaner body 22 will be described in detail with reference to the drawings.

As has been described hereinabove, air cleaner body 22 (see FIGS. 3 and 5) is connected to the rectangular lower opening 33 of upper case 25 in a manner to cover the same. As is seen from FIG. 3, air cleaner body 22 has a smoothly covered hollow body portion 22*a*, a rectangular flange 71 integrally formed on one end of hollow body portion 22*a* and a cylindrical air inlet portion 72 integrally formed on one side wall of hollow body portion 22*a*. Upon mounting of the air intake device on an associated motor vehicle, air inlet portion 72 is directed forward of the vehicle. Although not shown in the drawings, an air intake duct is connected to air inlet portion 72. The air intake duct runs and extends in a limited space of the engine room and has an air inlet mouth facing forward of the vehicle.

As is seen from FIGS. 3 and 11, a back wall 73 of air cleaner body 22 that faces air inlet portion 72 is curved smoothly to smoothly guide intake air toward air cleaner element 23 that is tightly mounted on rectangular flange 71.

Figure 12:
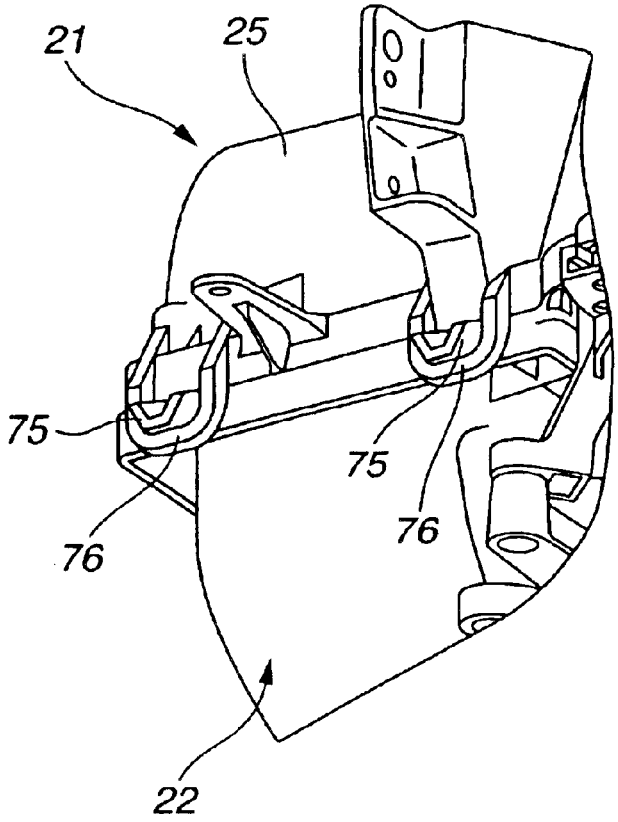
FIG. 12 is a perspective view of a portion of the air cleaner where a hinge is provided.

As is seen from FIGS. 11 and 12, a pair of hinges (75, 76) are provided between rectangular flange 71 of air cleaner body 22 and upper case 25 of air cleaner case 21. Thus, air cleaner body 22 can swing relative to upper case 25. That is, for changing air cleaner element 23, air cleaner body 22 is swung to expose or open the element 23. As is well shown in FIG. 12, each hinge comprises a projection 75 that is formed on rectangular flange 71 of air cleaner body 22 and a U-shaped catcher 76 that is formed on a peripheral portion (see FIG. 5) of rectangular opening 33 of upper case 25 of air cleaner case 21 and pivotally engaged with projection 75.

More specifically, as is seen from FIGS. 11 and 12, the projection 75 is shaped generally semi-cylindrical and has a hook portion 75*a* at a leading end thereof, and as is seen from FIG. 12, U-shaped catcher 76 is projected downward to pivotally engage with the projection 75. Due to provision of hook portion 75*a*, the pivotal engagement of U-shaped catcher 76 with projection 75 is stably kept.

It is now to be noted that even when air cleaner body 22 is swung down to expose air cleaner element 23, the body 22 is kept held by the hinges. However, when, for the purpose of taking the body 22 off the hinges, the body 22 is slightly lifted to disengage projections 75 from U-shaped catchers 76, the body 22 can be removed from upper case 25 of air cleaner case 21.

As is seen from FIG. 3, for holding air cleaner body 22 in its closed position relative to upper case 25, two clamps 77 are provided on the body 22. As is seen from FIGS. 10 and 11, each clamp 77 is constructed of a spring metal. Each clamp 77 has a lower end that is pivotally connected to a clamp mounting portion 78 formed on air cleaner body 22 and an upper bent portion that is engageable with a boss portion 79 of upper case 25 in a snap action manner. Accordingly, when clamps 77 are disengaged from boss portions 79, air cleaner body 22 is permitted to swing about the hinges (75, 76) between the closed position and the open position. While, when clamps 77 are engaged with boss portions 79, air cleaner body 22 is tightly fitted to the upper case 25 taking its closed position. Of course, as has been mentioned hereinabove, air cleaner element 23 is stably put between air cleaner body 22 and upper case 25 of air cleaner case 21.

Figure 10:
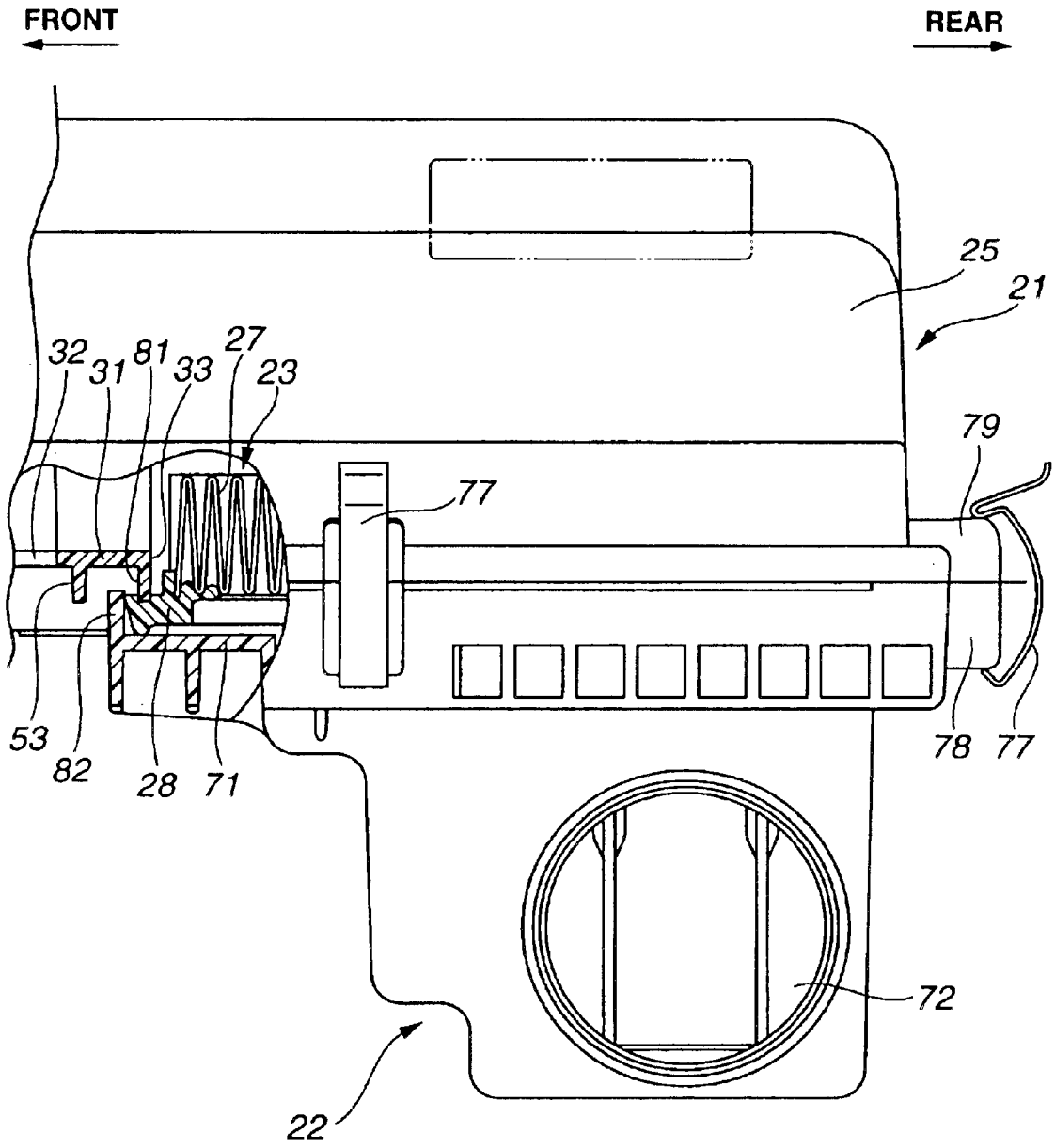
FIG. 10 is a partially cut side view of an essential portion of the air cleaner, taken from a lateral side of the engine.

That is, as is seen from FIG. 10, the air cleaner element 23 is put on rectangular flange 71 of air cleaner body 22. As shown, a sealing ridge 81 is integrally formed on the peripheral portion of rectangular opening 33 of upper case 25. Thus, upon closing of air cleaner body 22 relative to upper case 25, sealing ridge 81 is pressed against seal member 28 of air cleaner element 23 to achieve a sealing needed by air cleaner element 23. Rectangular flange 71 of air cleaner body 22 is formed around a periphery thereof with a holding ridge 82 for holding seal member 28. It is to be noted that holding ridge 82 is not provided on the ridge where the above-mentioned hinges (75, 76) are provided. Due to provision of holding ridge 82, air cleaner element 23 can be held in position even when air cleaner body 22 is swung down to assume its open position. This facilitates a manual work for changing air cleaner element 23.

When, as is seen from FIG. 1, the air intake device of the present invention is properly mounted on internal combustion engine 1, the flat air cleaner case 21 is postured so that the rear end portion thereof extends rearward from the rear end portion of the engine permitting location of air cleaner body 22 behind the rear end of the engine 1. That is, cylinder head cover 4 of the engine 1 and air cleaner body 22 are arranged in tandem. It is to be noted that in an engine room of motor vehicles, a transmission (not shown) is arranged just behind engine 1, which usually brings about a layout wherein due to a reduced size of a front portion of the transmission a certain space is defined just behind cylinder head cover 4. That is, in the present invention, the certain space is effectively used for receiving air cleaner body 22 and thus air cleaner body 22 is permitted to have a sufficient volume or capacity.

As is seen from FIG. 1, air cleaner element 23 is flatly put between air cleaner body 22 and air cleaner case 21 assuring a satisfied filtering area of air cleaner element 23 while preventing air cleaner case 21 from having a high height. A flat but longer construction of air cleaner case 21 brings about a satisfied volume of the same and thus exhibits an effective silencing performance with the aid of the volume of air cleaner body 22.

As has been described hereinabove, air cleaner element 23 can be easily replaced by new one by only opening air cleaner body 22. Furthermore, if desired, air cleaner body 22 can be removed from air cleaner case 21 by only handling hinges (75, 76). In this case, cleaning of the case 21 is easily made.

In the air intake device of the present invention, an arrangement is employed wherein air collection space (14) is integrally defined by air cleaner 11 and as is understood from FIG. 2, air collection space (14) and air cleaner element 23 are provided at longitudinally opposed portions of air cleaner 11, respectively. Thus, the air intake device of the present invention, that includes such arrangement, can be made compact in size, particularly in thickness.

The entire contents of Japanese Patent Application 2002-39655 (filed Feb. 18, 2002) are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. An air intake arrangement incorporated with an internal combustion engine, comprising:

an air cleaner case mounted on the engine and extending longitudinally along an upper wall of the engine;

an opening formed in a longitudinal end portion of a bottom wall of the air cleaner case;

an air cleaner body having an open end connected to the opening of the bottom wall of the air cleaner case thereby to communicate an interior of the air cleaner body with that of the air cleaner case; and an air cleaner element put between the air cleaner body and the air cleaner case in a manner to extend across the opening of the bottom wall of the air cleaner case;

wherein the longitudinal end portion of the bottom wall of the air cleaner case extends beyond one longitudinal end of the engine to thereby define a certain space below the longitudinal end portion of the bottom wall, the certain space accommodating the air cleaner body.

2. An air intake arrangement as claimed in claim 1, in which the interior of the air cleaner body is communicated with the open air through an opening formed in the air cleaner body and the interior of the air cleaner case is communicated with an intake part of the engine, so that the interior of the air cleaner body and that of the air cleaner case constitute dust and clean sides of the air cleaner element respectively.

3. An air intake arrangement as claimed in claim 2, in which the interior of the air cleaner case has an air outlet portion to which an air collection part of an intake manifold is connected.

4. An air intake arrangement as claimed in claim 2, in which the air cleaner case comprises:

a lower case adapted to be fixed to the upper wall of the engine; and an upper case mounted on the lower case in a manner to allow the air cleaner case to have a hollow structure.

5. An air intake device for use with an internal combustion engine, comprising:

an air cleaner case adapted to be mounted on the engine to extend longitudinally along an upper wall of the engine;

an opening formed in a longitudinal end portion of a bottom wall of the air cleaner case;

an air cleaner body having an open end connected to the opening of the bottom wall of the air cleaner case thereby to communicate an interior of the air cleaner body with that of the air cleaner case;

an air cleaner element put between the air cleaner body and the air cleaner case in a manner to extend across the opening of the bottom wall of the air cleaner case; and a throttle body that has an air passage in which a throttle valve is pivotally installed to selectively open and close the air passage, the throttle body being housed in the interior of the air cleaner case having the air passage connected to an air outlet portion of the air cleaner case, in which the interior of the air cleaner body is communicated with the open air through an opening formed in the air cleaner body and the interior of the air cleaner case is communicated with an intake part of the engine, so that the interior of the air cleaner body and that of the air cleaner case constitute dust and clean sides of the air cleaner element respectively, and in which the interior of the air cleaner case has the air outlet portion to which an air collection part of an intake manifold is connected.

6. An air intake device for use with an internal combustion engine, comprising:

an air cleaner case adapted to be mounted on the engine to extend longitudinally along an upper wall of the engine;

an opening formed in a longitudinal end portion of a bottom wall of the air cleaner case;

an air cleaner body having an open end connected to the opening of the bottom wall of the air cleaner case thereby to communicate an interior of the air cleaner body with that of the air cleaner case; and an air cleaner element put between the air cleaner body and the air cleaner case in a manner to extend across the opening of the bottom wall of the air cleaner case, in which the air cleaner body is pivotally connected to the bottom wall of the air cleaner case by a hinge mechanism.

7. An air intake device as claimed in claim 6, in which the open end of the air cleaner body is formed around a peripheral portion thereof with a holding ridge to hold the air cleaner element.

8. An air intake device as claimed in claim 6, in which the hinge mechanism comprises:

a projection formed on the air cleaner body; and a U-shaped catcher formed on the air cleaner case, the U-shaped catcher being pivotally engaged with the projection.

9. An air intake device as claimed in claim 8, in which the projection and the U-shaped catcher are detachably engaged.

10. An air intake arrangement as claimed in claim 1, further comprising a sound insulating member that is put between the upper wall of the engine and the air cleaner case.

11. An air intake arrangement as claimed in claim 1, in which the air cleaner case comprises:

a lower case adapted to be fixed to the upper wall of the engine;

an upper case longer than the lower case, the upper case being mounted on the lower case in such a manner that a given end portion of the upper case projects longitudinally outward beyond an end of the lower case, the given end portion having the opening to which the open end of the air cleaner body is connected.

12. An air intake device for use with an internal combustion engine, comprising:

an air cleaner case adapted to be mounted on the engine to extend longitudinally along an upper wall of the engine;

an opening formed in a longitudinal end portion of a bottom wall of the air cleaner case;

an air cleaner body having an open end connected to the opening of the bottom wall of the air cleaner case thereby to communicate an interior of the air cleaner body with that of the air cleaner case; and an air cleaner element put between the air cleaner body and the air cleaner case in a manner to extend across the opening of the bottom wall of the air cleaner case, in which the air cleaner case comprises;

a lower case adapted to be fixed to the upper wall of the engine; and an upper case longer than the lower case, the upper case being mounted on the lower case in such a manner that a given end portion of the upper case projects longitudinally outward beyond an end of the lower case, the given end portion having the opening to which the open end of the air cleaner body is connected, and in which the upper case comprises:

a first chamber defined by the given end portion of the upper case;

a second chamber defined by a major portion of the upper case;

a third chamber defined by the major portion of the upper case, the third and second chambers being separated by a partition wall arranged therebetween, the third chamber is placed on the second chamber;

an air outlet portion merged with an interior of the third chamber, the air outlet portion being adapted to connect to an intake part of the engine; and an opening formed in the partition wall to provide a fluid communication between the second and third chambers.

13. An air intake device as claimed in claim 12, further comprises a throttle body that is installed in the second chamber having its air passage connected to the opening of the partition wall.

14. An air intake device as claimed in claim 13, in which the throttle body comprises:

a passage having one end connected to the opening of the partition wall and the other end exposed to the interior of the second chamber;

a throttle valve pivotally installed in the passage to open and close the same; and an electric motor that drives the throttle valve.

15. An air intake device as claimed in claim 12, in which the first and second chambers are separated by a grid structure that has openings through which the first and second chambers are fluidly communicated.

16. An air intake device as claimed in claim 12, in which the third chamber comprises:

a depressed portion formed on the upper case; and a cover welded to the upper case to cover the depressed portion.

17. An air intake device as claimed in claim 12, in which the air cleaner body is pivotally connected to the given end portion of the upper case by means of a hinge mechanism.

18. An air intake device as claimed in claim 17, in which the hinge mechanism comprises:

a projection formed on the air cleaner body; and a U-shaped catcher formed on the air cleaner case and pivotally and detachably engaged with the projection.

19. An air intake device as claimed in claim 18, further comprising a clamp of spring metal for binding the air cleaner body to the air cleaner case, the clamp having one end that is pivotally connected to the air cleaner body and the other end that is engageable with a boss portion of the upper case of the air cleaner case in a snap action manner.

20. An air intake device as claimed in claim 19, in which the air cleaner body is formed around the opening thereof with a flange for putting thereon the air cleaner element.

21. An air intake device as claimed in claim 20, in which the air cleaner element comprises:

a seal member adapted to be disposed on the flange of the air cleaner body; and a pleated filter material mounted on the seal member.

22. An air intake device as claimed in claim 21, in which the given end portion of the upper case of the air cleaner case is formed with a sealing ridge that is pressed against the seal member of the air cleaner element to achieve sealing therebetween when the air cleaner body is tightly fitted to the given end portion of the upper case.

23. An air intake device for use with an internal combustion engine, comprising:

an elongate air cleaner case adapted to be mounted on the engine, the air cleaner case having a given end portion that extends beyond one longitudinal end of the engine;

an opening formed in the given end portion of the elongate air cleaner case;

an air cleaner body having an open end, the air cleaner body being pivotally connected to the given end portion of the air cleaner case, so that the air cleaner body is pivotal between a fitted position wherein the air cleaner body is tightly fitted to the given end portion thereby to connect the open end of the air cleaner body with the opening of the given end portion of the air cleaner case and a released position wherein the air cleaner body is separated from given end portion;

a clamp that detachably binds the air cleaner body and the air cleaner case together;

a flange formed around the open end of the air cleaner body; and an air cleaner element put on the flange, so that when the air cleaner body assumes the fitted position, the air cleaner element is put between the air cleaner body and the given end portion in a manner to extend to across the opening of the given end portion.

24. An air intake arrangement as claimed in claim 1, wherein the engine comprises an automobile engine.

* * * * *